US008104301B2

(12) United States Patent
Kang

(10) Patent No.: US 8,104,301 B2
(45) Date of Patent: Jan. 31, 2012

(54) REFRIGERANT VALVE CONTROL DEVICE AND CONTROL METHOD THEREOF

(75) Inventor: Dae Jong Kang, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 353 days.

(21) Appl. No.: 11/752,175

(22) Filed: May 22, 2007

(65) Prior Publication Data

US 2007/0271937 A1 Nov. 29, 2007

(30) Foreign Application Priority Data

May 22, 2006 (KR) ..... 10-2006-0045844

(51) Int. Cl.
*F25B 5/00* (2006.01)

(52) U.S. Cl. ..... 62/200; 62/222; 62/223

(58) Field of Classification Search ..... 62/200, 62/222, 223

See application file for complete search history.

(56) References Cited

U.S. PATENT DOCUMENTS

| | | | | |
|---|---|---|---|---|
| 4,674,292 | A * | 6/1987 | Ohya et al. | 62/223 |
| 5,241,833 | A * | 9/1993 | Ohkoshi | 62/126 |
| 5,626,030 | A * | 5/1997 | Nagai | 62/324.6 |
| 5,749,238 | A | 5/1998 | Schmidt | |
| 6,058,723 | A * | 5/2000 | Kusunoki et al. | 62/156 |
| 6,185,948 | B1 * | 2/2001 | Niki et al. | 62/199 |
| 6,370,895 | B1 * | 4/2002 | Sakuma et al. | 62/199 |
| 2004/0003613 | A1 * | 1/2004 | Shin et al. | 62/199 |

FOREIGN PATENT DOCUMENTS

| | | | |
|---|---|---|---|
| CN | 1247302 | A | 3/2000 |
| JP | 2000088427 | A * | 3/2000 |
| JP | 2001-004259 | A | 1/2001 |
| JP | 2001-355926 | A | 12/2001 |
| KR | 10-2005-0052053 | A | 6/2005 |

OTHER PUBLICATIONS

Machine translation(JP 2000088427 A).*
JP 2000-088427 A (English translation).*

* cited by examiner

*Primary Examiner* — Cheryl J Tyler
*Assistant Examiner* — Paolo Gonzalez
(74) *Attorney, Agent, or Firm* — Birch, Stewart, Kolasch & Birch, LLP

(57) ABSTRACT

The present invention relates to a refrigerant valve control device and a control method thereof, which adjusts eccentricity of a refrigerant valve during an operation of a refrigerator to prevent overcooling. A refrigerant valve control device of a refrigerator includes a temperature sensing part that senses temperature inside the refrigerator; a refrigerant valve that selectively opens and closes a refrigerant path; and a controlling part that controls the refrigerant valve based on temperature differences between the sensed temperature inside the refrigerator and a predetermined control temperature. In another aspect of the present invention, a control method of a refrigerant valve for a refrigerator includes determining whether refrigerant is leaked at a refrigerant valve based on temperature differences between the temperature inside the refrigerator and a predetermined control temperature; and controlling the refrigerant valve based on the result of the determination.

4 Claims, 3 Drawing Sheets

REFRIGERANT VALVE CONTROL DEVICE AND CONTROL METHOD THEREOF

CROSS REFERENCE TO RELATED APPLICATION

The present disclosure relates to subject matter in priority of Korean Patent Application No. 10-2006-0045844, filed on May 22, 2006, which is hereby incorporated by reference as if fully set forth herein.

BACKGROUND OF THE DISCLOSURE

1. Field of the Disclosure

The present invention relates to a refrigerator. More particularly, the present invention relates to a refrigerant valve control device and a control method thereof, which adjusts eccentricity of a refrigerant valve during an operation of a refrigerator to prevent overcooling.

2. Discussion of the Related Art

Freezing apparatus such as refrigerators typically adjusts temperature by using high temperature/high pressure refrigerant. The present specification embodies a refrigerator out of freezing apparatus to explain the above principle.

FIG. 3 is a diagram illustrating a freezing cycle having a refrigerant valve. As shown in FIG. 3, a freezing cycle of a refrigerator includes a compressor 11, a condenser 13 and a drying part 15. The compressor 11 compresses a refrigerant. The condenser 13 emits heat of the refrigerant compressed in the compressor. The drying part 15 is provided at a rear end of the condenser 13 to remove remaining moisture of the refrigerant.

Plural expansion valves 21 and 23 are connected to the drying part 15 and an outlet of the drying part 15, A refrigerant path is formed between inlets of the expansion valves 21 and 23 and the drying part 15. In addition, a 3-way refrigerant valve 17 is provided to connect a refrigerant path 19*c* formed at the outlet of the drying part 15 with refrigerant paths 19*a* and 19*b* formed at the inlets of the expansion valves 21 and 23.

The refrigerant valve 17 is controlled by a controller (not shown) to selectively close the refrigerant paths 19*a* and 19*b* connected with the expansion valves 21 and 23. That is, the refrigerant valve 17 opens and closes the refrigerant paths 19*a* and 19*b* connected with the expansion valves 21 and 23 connected to the dryer 15, respectively, such that the refrigerant paths 19*a* and 19*b* connected to the expansion valve 21 and 23 are selectively opened and closed.

Evaporators 25 and 27 are connected with rear ends of the expansion valves 21 and 23, respectively. The evaporators 25 and 27 produce cool air for cooling food items that are stored in the refrigerator. As a result, when the refrigerant paths connected to the rear ends of the evaporators 25 and 27, respectively, are connected to the compressor 11, the freezing cycle of the compressor 11→the condenser 13→the expansion valves 21 and 23→the evaporators 25 and 27→the compressor 11 is formed.

As a result, if the evaporator is provided in plural, the evaporators 25 and 27 control to supply cool air to each storage compartment of the refrigerator. That is, by the control of the refrigerant valve 17 is formed a freezing cycle of the compressor 11→the condenser 13→the expansion valve 21→the evaporator 25→the compressor 11, a freezing cycle of the compressor 11→the condenser 13→the expansion valve 21→the evaporator 27→the compressor 11, or a freezing cycle of the compressor 11→the condenser 13→the expansion valves 21 and 23→the evaporators 25 and 27→the compressor 11.

In other words, the refrigerant path 19*a* connected to the refrigerant valve 17, the expansion valve 21 and the evaporator 25 are configured to control the supply of cool air to a first storage compartment (for example, a refrigerator compartment). The refrigerant path 19*b* connected to the refrigerant valve 17, the expansion valve 23 and the evaporator 27 are configured to control the supply of cool air to a second storage compartment (for example, a freezer compartment).

FIG. 4 is a diagram illustrating a state in that refrigerant is leaked at a refrigerant valve of a conventional refrigerator.

First, a temperature sensor provided in the refrigerator senses a temperature valve and a temperature state within a refrigerator compartment or a freezer compartment is determined based on the sensed temperature valve. If the condition within the refrigerator compartment or the freezer compartment is unsatisfactory, cool air is supplied to the refrigerator compartment or the freezer compartment by performing a heat-exchanging process. At this time, the refrigerant valve 17 is operated to supply required refrigerant, such that the heat-exchanging process is performed.

Specifically, the compressor 11 is operated to compress refrigerant. Hence, the refrigerant is drawn through a refrigerant inlet 12 and the refrigerant is exhausted through a refrigerant outlet 14, such that heat-exchanging is performed. As a result, the evaporator is operated and cool air is produced to be supplied to the refrigerator compartment or the freezer compartment.

However, as shown in FIG. 4, eccentricity might occur at the refrigerant valve 17. If the refrigerant valve 17 is eccentric, a damper 16 for adjusting the amount of refrigerant may get loose and come off. The damper 16 may not return to its original portion and it maintains the eccentric state. As a result, the refrigerant drawn through the refrigerant inlet 12 is exhausted through the loose space of the damper 16 to be continuously leaked through the refrigerant outlet 14.

If the refrigerant is leaked continuously, the heat-exchanging process is repeatedly performed and thus the evaporation is performed too much by the evaporator. Thus, cool air is over-supplied to the refrigerator compartment or the freezer compartment, which results in overcooling inside the refrigerator.

SUMMARY OF THE DISCLOSURE

Accordingly, the present invention is directed to a refrigerant valve control device and a control method thereof.

An aspect of the present invention is to provide a refrigerant valve control device and a control method thereof, which adjusts eccentricity of a refrigerant valve produced during an operation of a refrigerator to prevent overcooling that might be caused by refrigerant leakage.

Another aspect of the present invention is to provide a refrigerant valve device for a refrigerator and a control method thereof, which can initializes a refrigerant valve to prevent refrigerant leakage when the refrigerator is in a state of overcooling.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these advantages and in accordance with the purpose of the invention, as embodied and broadly described herein, a refrigerant valve control device of a refrigerator includes a temperature sensing part that senses temperature inside the refrigerator; a refrigerant valve that selectively opens and closes a refrigerant path; and a controlling part that controls the refrigerant valve based on temperature differences between the sensed temperature inside the refrigerator and a predetermined control temperature.

The controlling part initializes the refrigerant valve, if the temperature difference value is substantially smaller than a predetermined standard value.

Here, the refrigerant valve includes a damper that opens and closes the refrigerant path.

The controlling part initializes an eccentric amount of the damper, if a temperature difference value is substantially smaller than a predetermined standard valve.

Preferably, the initialization is that a refrigerant path opening/closing state of the damper is initialized to allow the temperature inside the refrigerator to return to normal.

It is also preferred that the refrigerant valve is a multi-way valve that selectively opens and closes refrigerant paths connected to a refrigerator compartment and a freezer compartment, respectively.

In another aspect, a control method of a refrigerant valve for a refrigerator includes determining whether refrigerant is leaked at a refrigerant valve based on temperature differences between the temperature inside the refrigerator and a predetermined control temperature; and controlling the refrigerant valve based on the result of the determination.

The refrigerant valve is initialized, if the temperature difference value is substantially smaller than the predetermined standard value.

Preferably, the eccentric amount of a damper provided at the refrigerant valve is initialized, if the temperature difference value is substantially smaller than the predetermined standard value.

Here, the initialization is that a refrigerant path opening/closing state of the damper is initialized to allow the temperature inside the refrigerator to return to normal.

With the above configuration, the present invention determines whether refrigerant is leaked through the refrigerant valve by using the sensed temperatures inside the refrigerator. Therefore, the refrigerant according to the present invention may perform a normal freezing cycle without overcooling.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
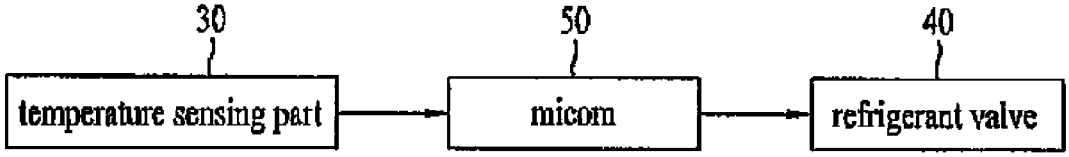
FIG. 1 is a diagram illustrating a refrigerant valve control device of a refrigerator according to the present invention.

FIG. 1 is a diagram illustrating a refrigerant valve control device of a refrigerator according to the present invention. As shown in FIG. 1, the refrigerator includes a temperature sensing part 30, a refrigerant valve 40 and a controlling part 50. The temperature sensing part 30 senses the temperature inside the refrigerator. The refrigerant valve 40 adjusts the amount of refrigerant circulation to supply cool air to storage compartments. The controlling part 50 that may be a micom controls the refrigerant valve 40 based on a predetermined algorithm according to the temperature sensed by the temperature sensing part 30.

The controlling part 50 determines whether the refrigerant valve 40 is eccentric and it initializes the refrigerant valve 40 to prevent refrigerant leakage. The refrigerator according to the present invention is organically relative to other configurations, for example, a compressor. However, the present invention describes only configurations related to a control method of the refrigerant valve.

Specifically, the temperature sensor 30 may be a thermistor for sensing the temperatures inside the storage compartments (the refrigerator compartment and the freezer compartment). That is, the temperature sensing part 30 senses the temperature inside at least one storage compartment and the sensed temperature is transmitted to the controlling part 50. The controlling part 50 may control to sense the temperature or the temperature sensing part 30 may independently sense the temperature to transmit the sensed temperature to the controlling part 50.

As mentioned above, the controlling part 50 controls the refrigerant valve 40 to selectively open and close refrigerant paths 19*a* and 19*b* connected to expansion valves 21 and 23. Here, the refrigerant valve 40 can open and close both of the refrigerant paths 19*a* and 19*b*.

For the selective opening and closing, the refrigerant valve 40 includes a damper 16, a motor, for example, a step motor (not shown), and a driving circuit (not shown). The damper 16 selectively opens and closes the refrigerant paths 19*a* and 19*b*. The motor (not shown) rotates the damper 16 within a predetermined angle range. The driving circuit (not shown) drives the motor (not shown). In addition, a stopper may be provided at the refrigerant valve 40 to limit the rotation of the damper 16 only within a predetermined angle.

For example, when the refrigerant valve 40 performs the selective opening and closing of the refrigerant paths by the step motor, the step motor (not shown) is operated by a pulse signal (or a step signal) generated by the driving part (not shown). The step motor is rotated by the pulse (or step) number and/or the size of the received pulse (or step) signals. The motor (not shown) may be rotated in a clockwise direction and counter-clockwise direction.

The controlling part 50 controls an overall freezing cycle based on a predetermined algorithm or a user's inputting. When the controlling part 50 controls the freezing cycle, the controlling part 50 receives the sensed refrigerator temperature ($t_r$) from the temperature sensing part 30 and it compares the sensed refrigerator temperature ($t_r$) with a predetermined control temperature that is predetermined based on the predetermined algorism or a control temperature that is predetermined by user's inputting. Hence, the controlling part 50 controls to operate the compressor and the refrigerant valve 40 based on the temperature differences. Next, the control of the refrigerant valve 40 for preventing refrigerant leakage will be explained in detail.

The controlling part 50 receives the temperature ($T_r$) inside at least one storage compartment from the temperature sensing part 30. For example, the controlling part 50 receives the temperature ($T_{r1}$) inside the refrigerator compartment and the temperature ($T_{r2}$) inside the freezer compartment. Hence, the controlling part 50 reads the predetermined control temperature ($T_{c1}$) of the refrigerator compartment and the predetermined control temperature ($T_{c2}$) of the freezer compartment. After that, the controlling part 50 compares the sensed temperatures ($T_{r1}$ and $T_{r2}$) with the predetermined control temperatures ($T_{c1}$ and $T_{c2}$), respectively, and it controls the refrigerant valve 40 based on the comparison result. In a normal case, the sensed temperatures ($T_{r1}$ and $T_{r2}$) are identical to or higher than the control temperatures ($T_{c1}$ and $T_{c2}$), respectively.

However, if the refrigerant valve 40 is eccentric with some reasons, refrigerant is continuously supplied along the refrigerant paths 19*a* and 19*b* through the refrigerant valve 40 regardless of the normal control of the controlling part 50. As a result, the temperature ($T_{r1}$) inside the refrigerator compartment and the temperature ($T_{r2}$) inside the freezer compartment are below the predetermined control temperatures ($T_{c1}$ and $T_{c2}$) and thus cool air is supplied to the food items stored in the storage compartments (the refrigerator compartment and the freezer compartment) too much, which results in overcooling.

Especially, in case of too much cool air supply, damage to the food items stored in the refrigerator compartment is more severe than damage to the food items stored in the freezer compartment. It is preferred that it is more important for the controlling part 50 to control the temperature inside the refrigerator compartment than to control the temperature inside the freezer compartment.

Thus, the controlling part 50 compares the sensed temperatures ($T_{r1}$ and $T_{r2}$) with the predetermined control temperatures ($T_{c1}$ and $T_{c2}$) and it determines a state of the refrigerant valve 40, specifically, whether the refrigerant valve 40 is eccentric. Hence, the refrigerant valve 40 is initialized according to the eccentricity, such that too much cool air is prevented. This controlling process is shown in FIG. 2 in detail.

Figure 2:
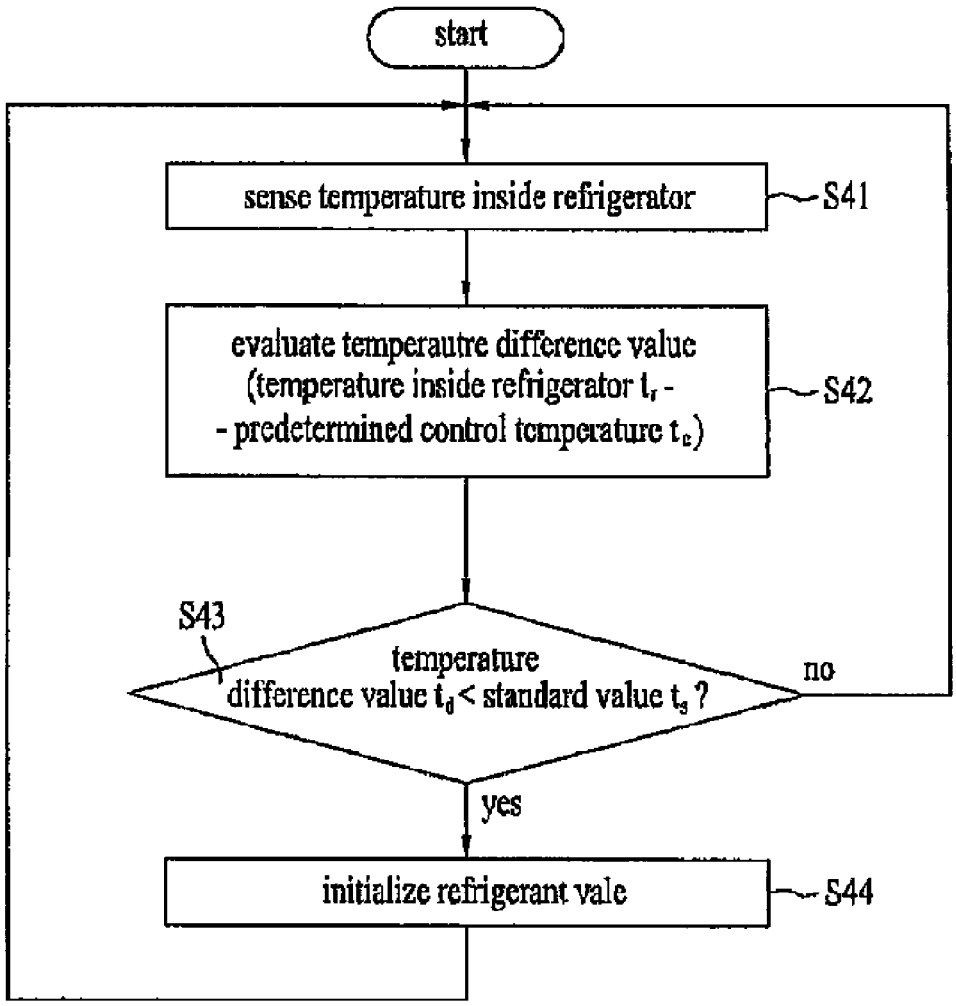
FIG. 2 is a flow chart illustrating a control method of the refrigerant valve control device shown in FIG. 1.
Figure 3:
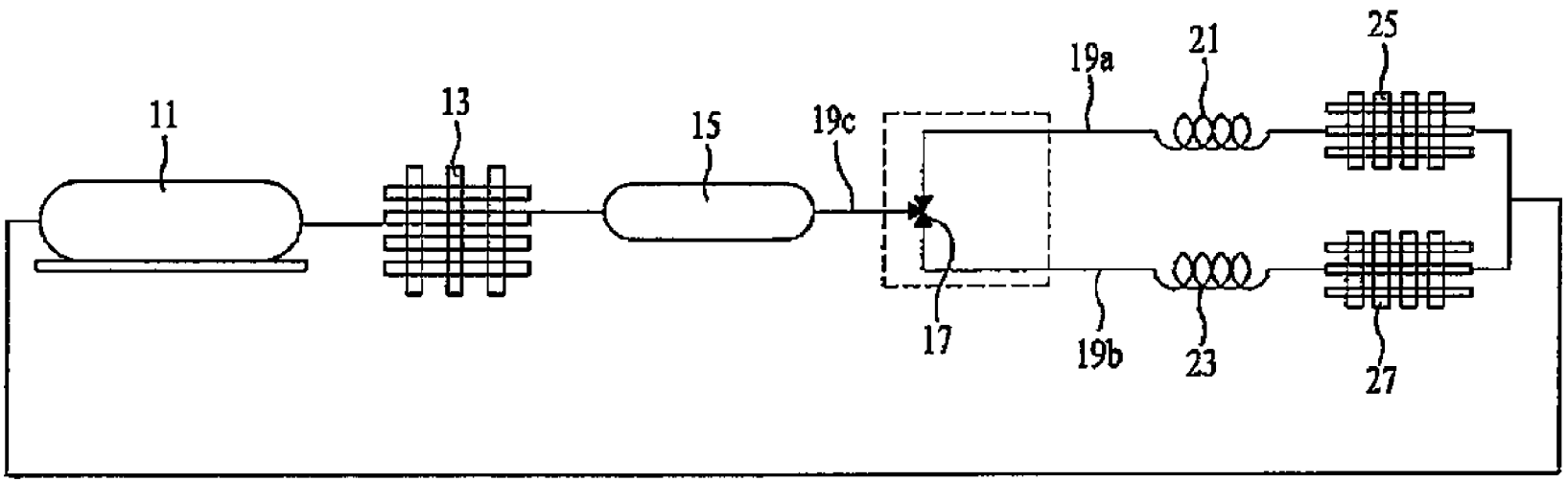
FIG. 3 Related Art
FIG. 3 is a diagram schematically illustrating a freezing cycle in which a conventional refrigerant valve is provided.
Figure 4:
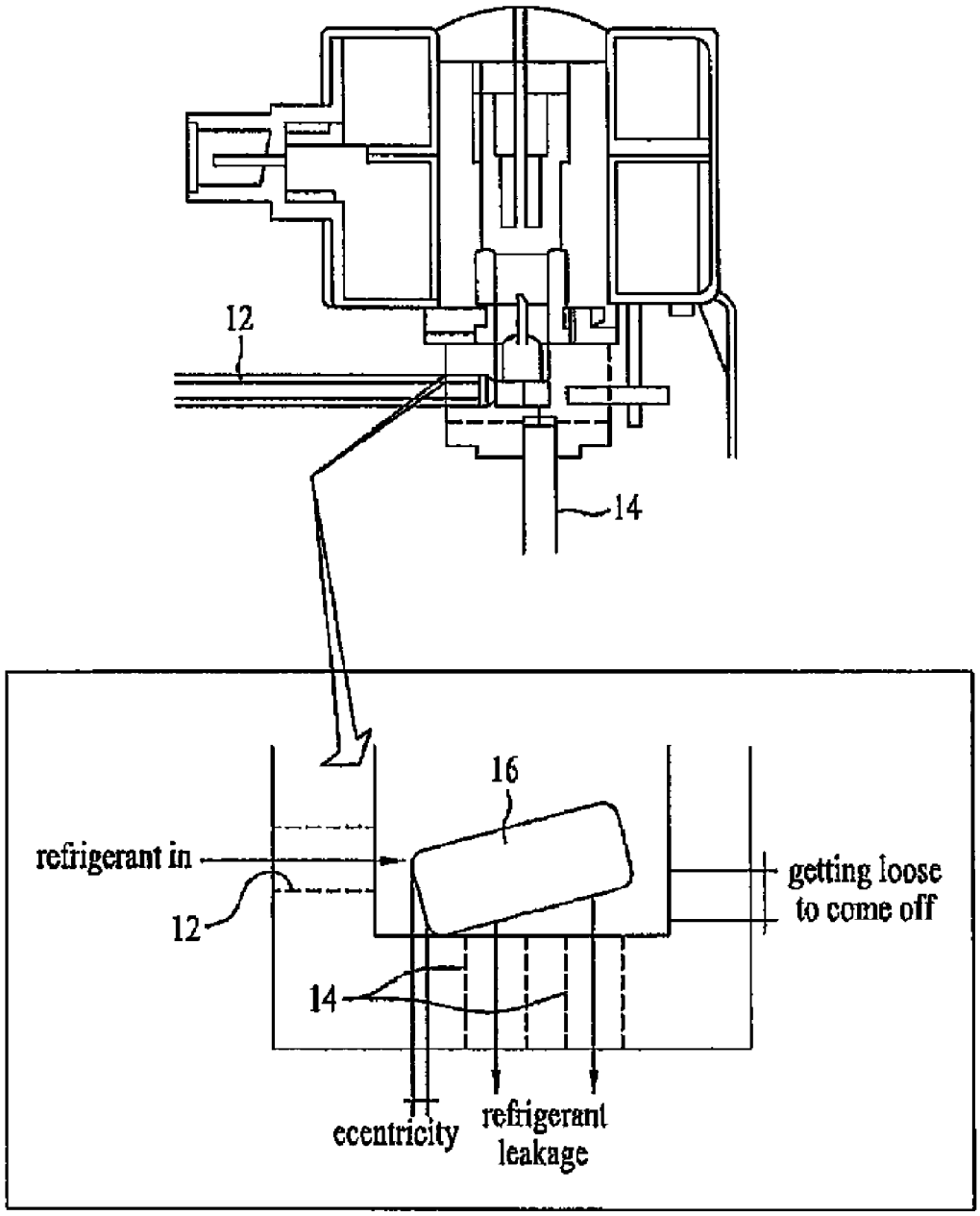
FIG. 4 Related Art
FIG. 4 is a diagram illustrating a state in which refrigerant leakage occurs in the conventional refrigerant valve.

FIG. 2 is a flow chart illustrating a refrigerant valve control method of the refrigerator according to the present invention.

The temperature sensing part 30 senses the temperatures ($T_{r1}$ and $T_{r2}$) inside the storage compartments (the refrigerator compartment and the freezer compartment) and it transmits the sensed temperatures ($T_{r1}$ and $T_{r2}$) to the controlling part 50 (S41).

The controlling part 50 evaluates temperature difference values ($T_{d1}$ and $T_{d2}$) between the sensed temperatures ($T_{r1}$ and $T_{r2}$) and the predetermined control temperatures ($T_{c1}$ and $T_{c2}$) (S42).

The controlling part 50 compares the evaluated temperature difference values ($T_{d1}$ and $T_{d2}$) with predetermined standard values ($T_{s1}$ and $T_{s2}$) (S43). The standard values ($T_{s1}$ and $T_{s2}$) are optimal temperature difference values or the lowest temperature difference values for determining that refrigerant is leaked.

For example, the standard values ($T_{s1}$ and $T_{s2}$) are predetermined at −3° C. and −4° C., respectively. If the temperature difference values ($T_{d1}$ and $T_{d2}$) are below the predetermined standard values ($T_{s1}$ and $T_{s2}$), it is determined that refrigerant is leaked and thus the refrigerant valve 40 is initialized to make the temperatures inside the storage compartments normal (S44). If the temperature difference values ($T_{d1}$ and $T_{d2}$) are not below the predetermined standard values ($T_{s1}$ and $T_{s2}$), it is determined that the refrigerant valve 40 is normally performed and thus the step of S41 is performed.

In the step of S43, the controlling part 50 may compares the temperature difference value ($T_{d1}$) of the refrigerator compartment and the temperature difference value ($T_{d2}$) of the freezer compartment with each standard value ($T_{s1}$ and $T_{s2}$). Hence, if both temperature difference values are below the standard values ($T_{s1}$ and $T_{s2}$), the controlling part 50 may perform the step of S44. Alternatively, if either of the two temperature difference values is below the standard values ($T_{s1}$ and $T_{s2}$), the controlling part 50 may perform the step of S44.

Especially, the controlling part 50 put more importance on the comparison between the temperature difference value ($T_{d1}$) of the refrigerator compartment and the corresponding standard value ($T_{s1}$). Hence, if the temperature difference value ($T_{d1}$) of the refrigerator compartment is below the corresponding standard value ($T_{s1}$), the step of S44 in that the refrigerant valve 40 is initialized may be performed to make the temperature inside the storage compartments normal, without considering the temperature difference value ($T_{d2}$) of the freezer compartment.

In the step of S44, the controlling part 50 determines that the refrigerant valve 40 is eccentric and that the refrigerant is leaked and thus the refrigerant valve 40 is initialized. In this initialization, the controlling part 50 produces and transmits a pulse (step) signal to the refrigerant valve 40 to rotate the step motor (not shown) in a reverse direction. The refrigerant valve 40 performs the reverse direction rotation, which means that the refrigerant valve 40 is initialized.

Typically, step motors have the largest pulse (step) to rotate at a predetermined angle and the step motors are controlled within a range of the pulse number. Hence, step motors are controlled within the largest pulse. Thus, for the initialization, the controlling part 50 applies the largest pulse to the refrigerant valve 40 to allow the reverse direction rotation and the position of the step motor is initialized to a predetermined original position, regardless of the present position of the step motor.

Because of the initialization, the damper 16 that adjusts a refrigerant amount restitutes to its original position and the controlling part 50 controls a normal freezing cycle to be performed after initialization of the damper position.

FIG. 2 illustrates only the refrigerant valve control method according to the present invention and thus normal control steps are omitted. However, it is well-known to those skilled in this art that the normal control steps and the control steps of the present invention are performed in order or simultaneously.

The refrigerant valve control device and the control method thereof according to the present invention may have following advantageous effects.

First, it is determined whether refrigerant is leaked through the refrigerant valve by the sensed temperatures inside the storage compartments. As a result, the freezing cycle can be normally performed without overcooling.

Furthermore, the present invention presents the simple method for initializing the refrigerant valve, because the eccentric amount of the damper is controlled to prevent refrigerant leakage.

A still further, refrigerant leakage is prevented by using the temperature sensors and the refrigerant valve, because any auxiliary devices are not provided to determine whether refrigerant is leaked, which results in fast determination and solution of overcooling.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerant valve control device of a refrigerator comprising:

a temperature sensing part that senses a temperature inside a compartment of the refrigerator;

a refrigerant path;

a refrigerant valve that selectively opens and closes the refrigerant path; and a controlling part that controls the refrigerant valve based on a temperature difference value between the sensed temperature inside the compartment of the refrigerator and a predetermined control temperature, wherein the controlling part initializes the refrigerant valve if the temperature difference value is smaller than a predetermined standard value, wherein the refrigerant valve comprises a damper that opens and closes the refrigerant path, wherein the controlling part initializes a rotational movement in the position of the damper if the temperature difference value is smaller than the predetermined standard value, wherein a refrigerant path opening/closing state of the damper is initialized to allow the temperature inside the compartment of the refrigerator to rise so that the temperature difference value is greater than the predetermined standard value, and wherein the rotational movement of the damper is initiated to adjust eccentricity of the damper in order to prevent refrigerant leakage.

2. The refrigerant valve control device as claimed in claim 1, wherein the refrigerant valve is a multi-way valve that selectively opens and closes refrigerant paths connected to a refrigerator compartment and a freezer compartment, respectively.

3. A control method of a refrigerant valve for a refrigerator comprising:

detecting a temperature difference between a temperature inside a compartment of the refrigerator and a predetermined control temperature;

comparing the temperature difference to a predetermined standard value; and rotating a damper provided at the refrigerant valve to initialize the refrigerant valve if the detected value of the temperature difference is smaller than the predetermined standard; value, wherein initializing the refrigerant valve is initializing a refrigerant path opening/closing state of the damper and maintaining the refrigerant path open/closing state of the damper to allow the temperature inside the refrigerator to rise so that the temperature difference value is greater than the predetermined standard value, and wherein rotating the damper is initiated to adjust eccentricity of the damper in order to prevent refrigerant leakage.

4. The refrigerant valve control device as claimed in claim 1, wherein the controlling part initializes the refrigerant valve by rotating the refrigerant valve to close the refrigerant path.

* * * * *